US010531775B2

(12) United States Patent
Reeves et al.

(10) Patent No.: US 10,531,775 B2
(45) Date of Patent: Jan. 14, 2020

(54) CLEANING DEVICE

(71) Applicant: BLACK & DECKER INC., New Britain, CT (US)

(72) Inventors: Mark Reeves, Durham (GB); Graeme Crawley, Newcastle-upon-Tyne (GB); Conor James Kirkpatrick, North Lanarkshire (GB)

(73) Assignee: Black & Decker, Inc., New Britain, CT (US)

( * ) Notice: Subject to any disclaimer, the term of this patent is extended or adjusted under 35 U.S.C. 154(b) by 0 days.

(21) Appl. No.: 15/805,665

(22) Filed: Nov. 7, 2017

(65) Prior Publication Data

US 2018/0132687 A1 May 17, 2018

(30) Foreign Application Priority Data

Nov. 16, 2016 (EP) ..... 16199098

(51) Int. Cl.
*A47L 5/24* (2006.01)
*A47L 9/14* (2006.01)
(Continued)

(52) U.S. Cl.
CPC ..... *A47L 9/149* (2013.01); *A47L 5/24* (2013.01); *A47L 9/12* (2013.01); *A47L 9/2857* (2013.01)

(58) Field of Classification Search
CPC ... A47L 9/149; A47L 5/24; A47L 9/02; A47L 9/102; A47L 9/106; A47L 9/12;
(Continued)

(56) References Cited

U.S. PATENT DOCUMENTS

2006/0162117 A1 7/2006 Thomas et al.
2008/0040883 A1* 2/2008 Beskow ..... A47L 5/225 15/329
(Continued)

FOREIGN PATENT DOCUMENTS

DE 102014005154 10/2015
EP 2389849 11/2011
(Continued)

OTHER PUBLICATIONS

EP Search Report dated May 8, 2017 relating to EP Application No. 16199098.

*Primary Examiner* — Robert J Scruggs
(74) *Attorney, Agent, or Firm* — John Yun

(57) ABSTRACT

A vacuum cleaner comprises a housing and a motor fan assembly arranged to generate an air flow. A detachable dirt container is mountable to the housing and the dirt container has a dirty air inlet in fluid communication with the motor fan assembly. A filter is for separating dirt from the air flow and the filter is mounted between the dirt container and the motor fan assembly. Wherein the detachable dirt container comprises an emptying aperture in a wall of the dirt container, the emptying aperture being downstream in the air flow from the dirty air inlet and upstream of the filter. Wherein the housing comprises an overlap portion for covering the emptying aperture in the dirt container and sealing the emptying aperture when the detachable dirt container is mounted to the housing.

17 Claims, 4 Drawing Sheets

(51) Int. Cl.
*A47L 9/12* (2006.01)
*A47L 9/28* (2006.01)

(58) Field of Classification Search
CPC ..... A47L 9/122; A47L 9/2857; A47L 9/20; A47L 9/1666; A47L 9/1691; A47L 5/28; A47L 9/1683
See application file for complete search history.

(56) References Cited

U.S. PATENT DOCUMENTS

2014/0059799 A1* 3/2014 Kim ..... A47L 9/16 15/353
2014/0366311 A1* 12/2014 Han ..... A47L 9/16 15/339

FOREIGN PATENT DOCUMENTS

WO WO02067753 9/2002
WO WO2004069021 8/2004
WO WO2008088278 7/2008

* cited by examiner

CLEANING DEVICE

CROSS-REFERENCE TO RELATED APPLICATION

This application claims priority to European Patent Application No. 16199098.1 filed Nov. 16, 2016. The entire contents of that application are expressly incorporated herein by reference.

FIELD OF THE INVENTION

The present invention relates to a vacuum cleaner.

BACKGROUND OF THE INVENTION

Many people use vacuum cleaners to clean and tidy their homes.

Normally vacuum cleaners are used to pick up dust and debris using a negative pressure. Dust and debris is entrained in an air flow and sucked into the body of the vacuum cleaner wherein the dust and debris are separated from the air flow. Once separated from the air flow, the dust and debris are collected and usually emptied in a dustbin at the user's convenience.

Some vacuum cleaners have complicated mechanisms for emptying the dirt container. For example EP 1 377 197 discloses a trigger mechanically coupled to a rod and latch release mechanism for a lid of the dust container. The user may not understand how to release the lid of the dust container and may damage the latch mechanism by attempting to prise the lid open.

Another vacuum cleaner is shown in EP 1 594 386 whereby a hinged door allows the user to selectively access the dust container. The hinged door may become clogged with dust over time hindering movement of the hinged door. Furthermore it is possible for the user to accidentally actuate the hinged door during use because it is at the nozzle end of the vacuum cleaner. Furthermore the user has to place their hands in close proximity to the door to release the door and thereby getting their hands soiled when emptying the dust container.

Embodiments described hereinafter aim to address the aforementioned problems.

SUMMARY OF THE INVENTION

According to an aspect of the present invention there is a vacuum cleaner comprising: a housing; a motor fan assembly arranged to generate an air flow; a detachable dirt container mountable to the housing; the dirt container having a dirty air inlet in fluid communication with the motor fan assembly; a filter for separating dirt from the air flow, the filter being mounted between the dirt container and the motor fan assembly; wherein the detachable dirt container comprises an emptying aperture in a wall of the dirt container, the emptying aperture being downstream in the air flow from the dirty air inlet and upstream of the filter, wherein the housing comprises an overlap portion for covering the emptying aperture in the dirt container and sealing the emptying aperture when the detachable dirt container is mounted to the housing.

This means that the dirt bypasses the filter when emptying the dirt container. The user does not have to touch the filter or the soiled parts of the dirt container during a normal emptying action. This means that the user does not get dirt on their hands because the user only touches clean parts of the vacuum cleaner during the emptying action.

Preferably the dirty air inlet is integral with the dirt container. Preferably the dirty air inlet is an integral nozzle protruding from the dirt container. Preferably the housing comprises a first handle and the dirt container comprises a second handle for holding the dirt container. Preferably the integral nozzle comprises the second handle. This means that the user has a convenient gripping location which is also the nozzle. This means that the user does not have to grip the dirt container anywhere near the dirty parts of the dirt container.

Preferably the periphery of the emptying aperture comprises a seal engageable with the overlap portion. Preferably the overlap portion comprises a recess for receiving the seal. This means that there is a good seal between the dirt container and the housing. This means that airflow only enters the vacuum cleaner via the dirty air inlet.

Preferably wherein the vacuum cleaner comprises a releasable latch mechanism for selectively releasing the dirt container from the housing. Preferably the latch mechanism comprises a first portion of the latch mechanism on the housing and a second reciprocal portion of the latch mechanism on the dirt container. Preferably the latch mechanism comprises a latch release button mounted in the housing for actuating the latch mechanism. Preferably the latch release button is mounted in the first handle and actuatable with a user's thumb. This means that the user is less likely to accidently detach the dirt container from the housing.

Preferably the filter is removable from the dirt container. Preferably the filter is mountable on the dirt container and extends across a side of the dirt container opposite to the dirty air inlet. Preferably filter is a wall of the dirt container. Since the filter is removable it is replaceable and can be easily cleaned and maintained. The filter forms a wall of the dirt container and this makes a more compact vacuum cleaner requiring less parts and materials.

Preferably the vacuum cleaner is a handheld vacuum cleaner.

BRIEF DESCRIPTION OF THE DRAWINGS

Various other aspects and further embodiments are also described in the following detailed description and in the attached claims with reference to the accompanying drawings, in which:

DETAILED DESCRIPTION OF INVENTION

Figure 1:
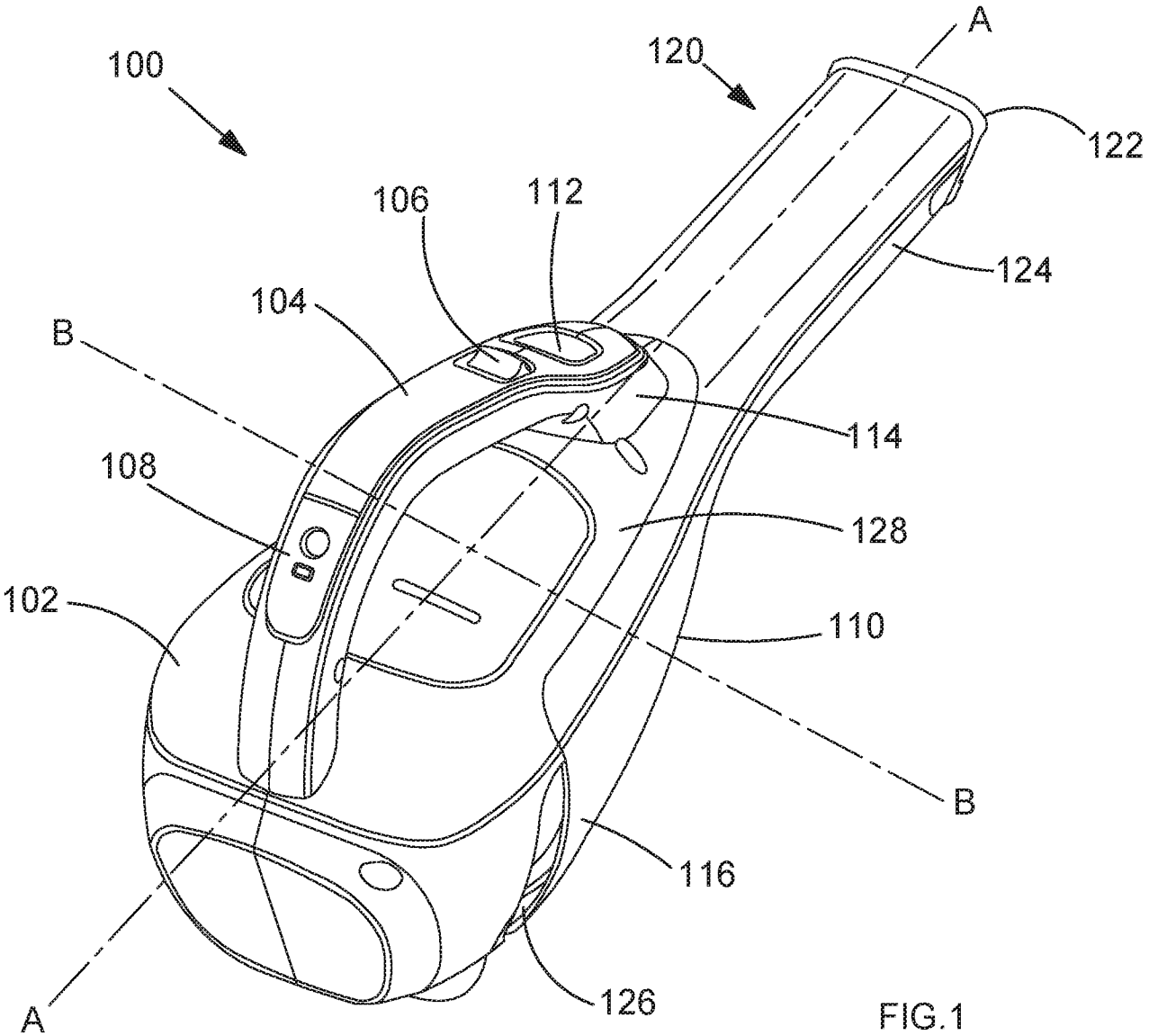
FIG. 1 shows a perspective view of a vacuum cleaner.

FIG. 1 shows a perspective view of a vacuum cleaner 100. The vacuum cleaner 100 as shown in FIG. 1 is a handheld vacuum cleaner, but in other embodiments the vacuum cleaner 100 may be an upright vacuum cleaner, a stickvac, a canister vacuum cleaner or any other type of vacuum cleaner. References to vacuum cleaner 100 hereinafter will be in reference to the handheld vacuum cleaner as shown in the Figures.

Vacuum cleaner 100 has a housing 102 which comprises two clam-shell halves fixed together. A motor-fan assembly (not shown) is housed within the housing 102. The motor fan assembly is arranged to create a negative pressure for creating an airflow for sucking up dirt and debris.

The housing 102 comprises a first handle 104. The first handle 104 is integral with the housing 102 and the user grips the first handle when operating the vacuum cleaner 100. The handle comprises an ON/OFF switch 106 for operating the vacuum cleaner. In some embodiments the handle comprises indicators for providing information about the vacuum cleaner 100 to the user. A battery indicator 108 is mounted on the handle for indicating to the user the charge level status of the battery. Further indicators (not shown) such as filter status indicators (filter blocked/filter cleared) can be mounted on the handle or elsewhere on the housing. In other embodiments the indicator 108 is a symbol indicating to the user where to charge the vacuum cleaner.

A detachable dirt container 110 is mounted to the housing 102. The detachable dirt container 110 is coupled to the housing 102 via a latch mechanism 302 which will be discussed in further detail in respect of FIG. 3. The latch mechanism 302 is actuated with a latch release button 112. The latch release button 112 is mounted in the first handle 104. The latch release button 112 is mounted on a forward portion 114 of the first handle 104. This means that the user is able to actuate the latch mechanism with their thumb when they are gripping the first handle 104.

The detachable dirt container 110 comprises a first projecting side lip 116 and a second projecting side lip 118. The first and second projecting side lips are arranged to envelope a portion of the housing 102. When the detachable dirt container 110 is mounted on the housing, the detachable dirt container is flush with the surface of the housing 102.

The detachable dirt container 110 comprises a nozzle 120 having a dirty air inlet 122. The nozzle 120 is hollow and comprises a conduit such that the dirty air inlet 122 is in fluid communication with the dirt container 110. The nozzle 120 is integral with the detachable dirt container 110 and projects forwardly away from the housing 102. In some embodiments the nozzle 120 can be a detachable and removable component of the dirt container 110. In this case there are seals and latches (not shown) for coupling the detachable nozzle.

The vacuum cleaner 100 inherently has a directionality. There term "forward" refers to the nozzle 120 end of the vacuum cleaner. The term "rearward" refers to the back end of the vacuum cleaner where the motor fan assembly is housed in the housing 102. The rearward end of the vacuum cleaner 100 is opposite the forward end of the vacuum cleaner. The term "top" refers to the upper side of vacuum cleaner where the first handle 104 is mounted. When the user grips the first handle 104, the vacuum cleaner 100 will naturally hang below the first handle 104.

Figure 2:
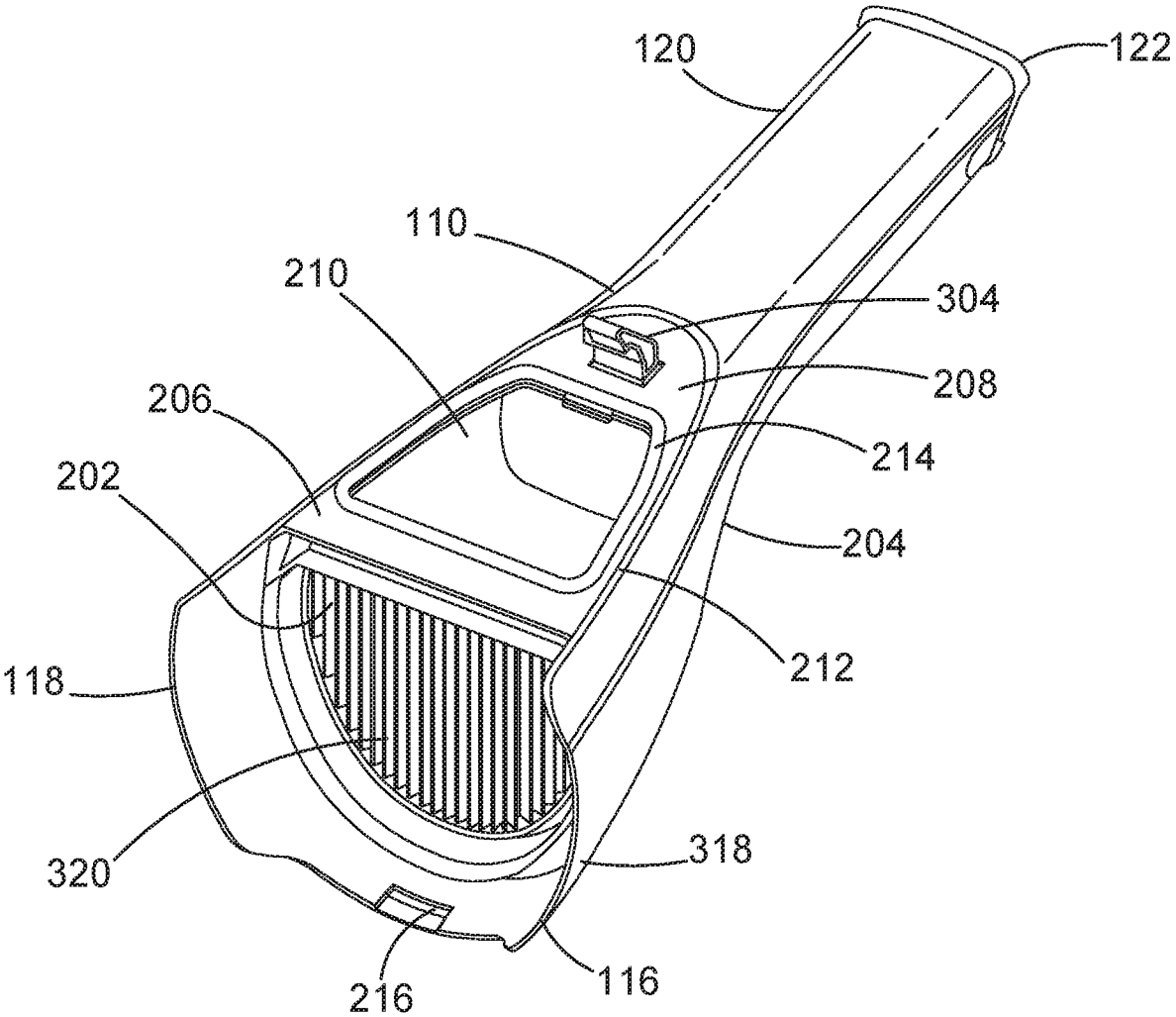
FIG. 2 shows partial perspective view of the vacuum cleaner.

During operation of the vacuum cleaner 100, the motor fan assembly creates a negative pressure and sucks an air flow through the nozzle 120 and the dirt container 110. The dirt is separated from the air flow when the air flow passes through the filter 202 (as shown in FIG. 2). The direction of the airflow can be seen in FIG. 3 whereby the air flow is represented by arrows. The clean air is then exhaust from the motor fan assembly through side vents 126. The side vents 126 guide the exhaust clean air rearward in a direction away from the nozzle 120 and generally from the vacuum cleaner 100.

The nozzle 120 comprises a second handle 124. The second handle 124 is a gripping portion of the projecting nozzle which is suitable for the user to wrap their fingers around. The diameter and cross section of the nozzle 120 is shaped so that a user's hand can wrap entirely or substantially around the nozzle 120. This means that the user can comfortably and securely grasp the nozzle 120 and the detachable dirt container 110.

The detachable dirt container 110 will now be discussed in more detail in reference to FIG. 2. FIG. 2 shows a perspective view of the detachable dirt container 110 removed from the housing 102. The detachable dirt container 110 is configured to be mountable on the housing 102. The detachable dirt container 110 comprises an exterior portion 204 which is exposed to the external environment when the detachable dirt container 110 is mounted on the housing 102. A portion of the dirt container 110 is an interior portion 206 which is inside the housing 102 and not exposed to the external environment when the dirt container 110 is mounted on the housing 102.

The internal portion 206 comprises an internal top portion 208. The internal top portion 208 is the portion of the dirt container 110 that is immediately adjacent the housing 102 when the dirt container 110 is mounted on the housing 102. An emptying aperture 210 is located in the internal top portion 208 of the dirt container 110. The emptying aperture 210 exposes the inside of the dirt container 110 to the external environment when the dirt container 110 is separated from the housing 102. The emptying aperture 210 allows dirt and debris which has been collected by the vacuum cleaner to be removed from the dirt container 110.

A peripheral lip 212 of the emptying aperture comprises a peripheral seal 214 for sealing against an interior surface of the housing 102. The peripheral seal 214 is engageable with the overlap portion 128. In some embodiments the seal 214 is a resiliently deformable material. The seal 214 is mounted on the peripheral lip 212 but in other embodiments the seal 214 is mounted on the underside of the overlap portion 128. In some embodiments the peripheral seal 214 a rubber material. Alternatively the seal is integral with the dirt container 110 and is a projecting member. In some embodiments, no additional seal element is required because engaging surfaces of the dirt container 110 and the housing 102 provide a suitably sufficient seal. For example the negative pressure created by the motor fan assembly will suck the dirt container 110 against the housing 102.

The internal top portion 208 has an inherent directionality because the top portion 208 will face up away from the floor when detached from the housing 102. The internal top portion 208 is overlaid by an overlap portion 128 of the housing 102. The overlap portion 128 is best seen from FIGS. 1 and 3. The overlap portion 128 is integral with the housing 102. The overlap portion 128 projects forwardly from the housing 102 towards the nozzle 120.

By placing the emptying aperture 210 on the internal top portion 208, the user will detach the dirt container 110 with the emptying aperture 210 facing upwards. This means that the user will not spill the dirt from the dirt container on the floor when first removing the dirt container 110 from the housing 102.

Figure 3:
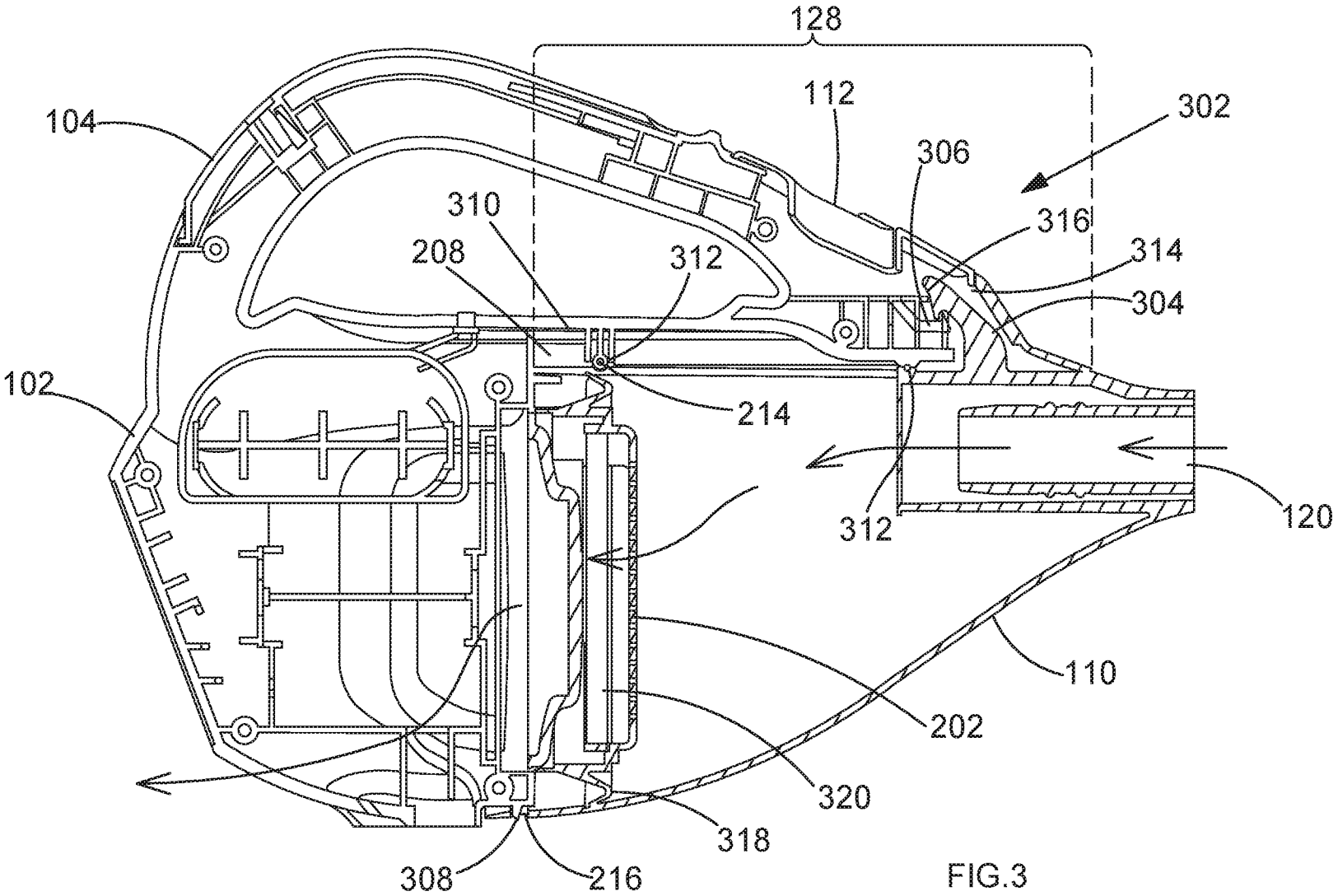
FIG. 3 shows a side cross sectional view of the vacuum cleaner along the axis A-A.
Figure 4:
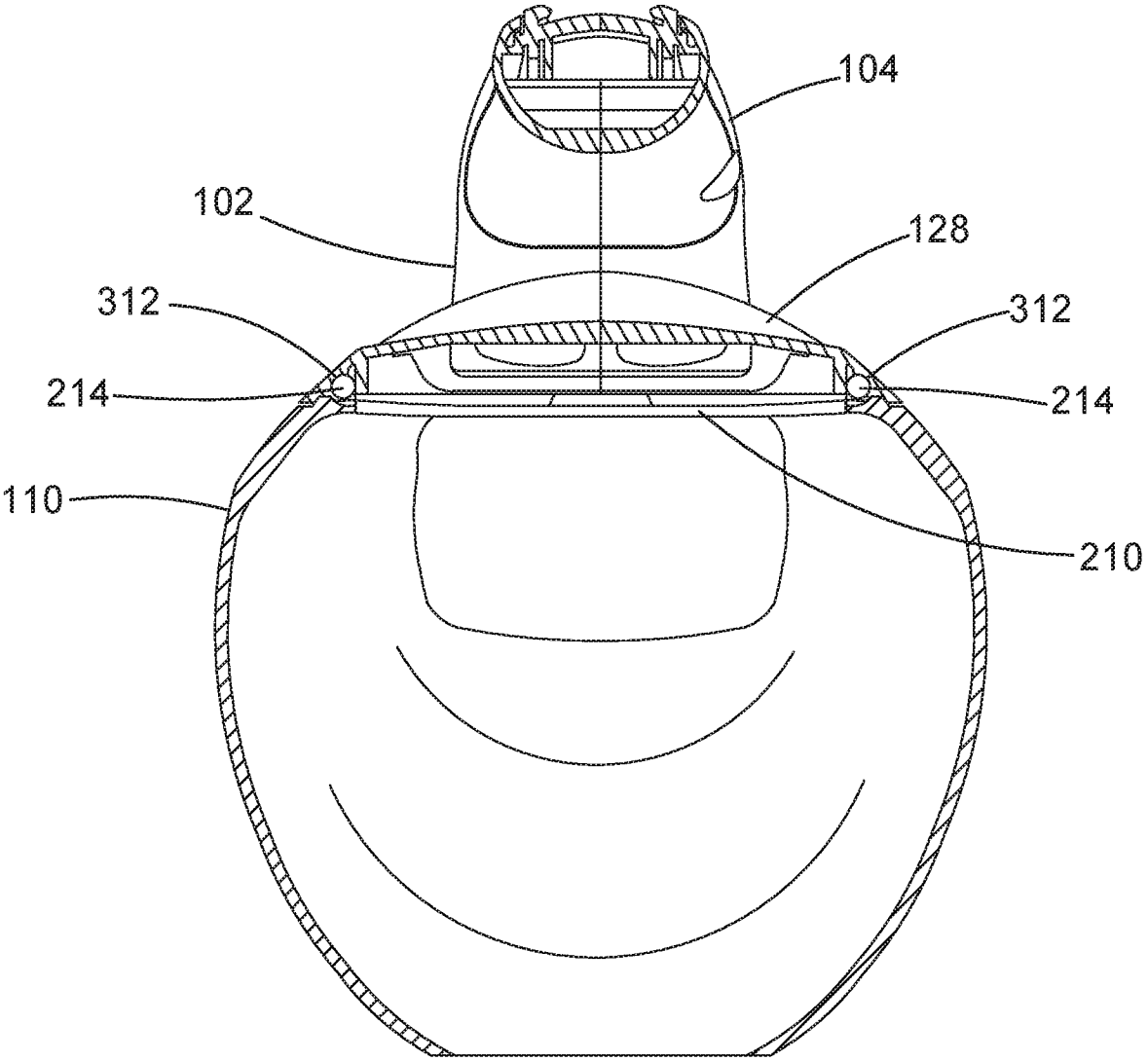
FIG. 4 shows a front cross sectional view of the vacuum cleaner along the axis B-B.

The mounting of the detachable dirt container 110 will now be discussed in reference to FIGS. 3 and 4. FIG. 3 shows a side cross section of the vacuum cleaner along the axis A-A (shown in FIG. 1). FIG. 3 shows the detachable dirt container 110 mounted on the housing 102. The nozzle 120 is partially shown and the dirty air inlet 122 is not shown in FIG. 3. FIG. 4 shows a forward cross section of the vacuum cleaner along the axis B-B (as shown in FIG. 1)

The overlap portion 128 shown in FIG. 3 with dotted lines indicating the portion of the housing 102 which extends forward and overlaps the dirt container 110. As can be seen the first handle 104 is coupled to the overlap portion 128.

When the dirt container 110 is mounted on the housing 102, the interior top portion 208 is adjacent to the interior surface 310 of the overlap portion 128. The peripheral seal 214 is received in a reciprocal recess 312. The reciprocal recess 312 is the same shape as the peripheral lip 212 of the emptying aperture 210. When the peripheral seal 214 is seated in the reciprocal recess, the dirt container 110 is sealed against the housing 102. This means that there is no air flow path from the external environment to the dirt container 110 through the emptying aperture 210. This can also be seen from FIG. 4.

In some embodiments the dirt container 110 comprises the reciprocal recess 312 and the housing 102 comprises the seal 214.

The latching mechanism 302 and operation will now be described in further detail. The latch mechanism 302 is optional. For example in other embodiments the dirt container 110 is mounted on the housing 102 with other solutions such as resilient clips or a friction fit. In the embodiment shown in the Figures, the dirt container 110 is selectively releasable from the housing 102 with the latch mechanism 302. The latch mechanism 302 comprises a first portion 304 and a second reciprocal portion 306. The first portion 304 is a resilient hook portion 304 and the second portion 306 is a moveably biased latch portion 306. FIG. 3 show the latch mechanism 302 in a locked position whereby the dirt container 110 is fixed to the hosing 102. The latch portion 306 moves between a release position and a locked position. In the release position the latch portion 306 moves away clear from the hook portion 304. This means that the hook portion 304 is free to move out of the hole 314. The latch portion 306 is biased to the locked position. The latch portion 306 is biased with a spring or any other suitable biasing means.

The latch mechanism 302 is actuated by the latch release button 112. The latch release button is mechanically coupled to the latch portion 306. In some embodiments the latch portion is integral with the latch release button 112. The hook portion 304 comprises a cam surface 316. When the dirt container is coupled together with the hosing 102 and the hook portion 304 is inserted into the hole 314, the cam surface 316 pushes the latch portion 306 away from the locked position. The latch portion 306 snaps back into the locked position when the cam surface 316 moves past the latch portion 306. This locks the hook portion 304 and the dirt container 110 in place.

As mentioned above, the latch release button 112 is mounted on a forward portion 114 of the first handle 104. This means that the user is able to actuate the latch mechanism with their thumb when they are gripping the first handle 104. The latch release button 112 is mounted forward of the normal grip position of the first handle 104. This means that the user must positively move their thumb and press the button 112 in order to release the dirt container 110. This means that the dirt container being accidentally released is less likely.

In order to locate and seat the dirt container 110 accurately in the housing 102, the dirt container 110 optionally comprises a guide hole 216 on the underside of the dirt container 110. The guide hole 216 is on the side of the dirt container 110 opposite to the latch mechanism 302. The guide hole 216 engages with a protruding tongue 308. The protruding tongue 308 is integral with the housing 102. Once the guide hole 216 engages with the protruding tongue 308, the dirt container 110 pivots about the protruding tongue. The projecting side lips 116, 118 also guide the dirt container 110 around the housing 102 as the dirt container 110 pivots. This means that the hook portion 304 is aligned with the hole when the dirt container 110 is mounted to the housing. This reduces the chances of the dirt container 110 being misaligned by the user.

The filter 202 will now be discussed in further detail. The filter 202 comprises a pleated filter material 320 for separating the dirt and debris form the dirty airflow. As shown in FIG. 2, the filter 202 extends across the entire side of the dirt container 110 opposite the dirty are inlet 122. In this way the filter 202 fills the entire cross section of the dirt container 110 at a rearward end of the dirt container 110. The filter 202 comprises a filter sealing edge 318. The filter sealing edge 318 comprises a resiliently flexible portion of material that is compressed when mounted in the dirt container 110. The filter sealing edge 318 is urged against the inside surface of the dirt container 110 and seals there against. This means that when the filter 202 is mounted in the dirt container 110, the air flow only passes through the pleated filter material 320.

In some embodiments the filter 202 is wedged into the dirt container 110 using a friction fit. In other embodiments, the filter 202 is mounted using other means such as glue, or ribs which slot into rails or any other suitable mounting means. In some embodiments the filter 202 is removable and replaceable. This means that if the dirt container 110 needs a deep clean, the user can remove the filter 202 after removing the dirt container 110. This means that the user can gain access to the interior of the dirt container 110 when the filter 202 is removed. This means for example the user can run the dirt container 110 under the tap and/or clean the filter separately.

The emptying operation of the vacuum cleaner 100 will now be described. The user grips the first handle 104 with their first hand. The user then grips the second handle 124 on the nozzle 120 with their second hand. This means that the user is gripping both parts of the vacuum cleaner and they will not drop them when the housing 102 separates from the dirt container 110. The user then extends their thumb and presses the latch release button 112. The latch mechanism 302 is then moved into the release position and the hook portion 304 and the dirt container 110 are moveable with respect to the housing 102. The housing 102 and overlap portion 128 are then lifted away from the dirt container 110 as the housing 102 pivots about the guide hole 216. Once the dirt container 110 is separated from the housing 102, the emptying aperture 210 is revealed. The first and second handles 104, 124 naturally mean that the user will always open the vacuum cleaner 100 with the emptying aperture 210 facing upwards. The user can then move the dirt container 110 to a dustbin and rotate it such that the emptying aperture faces downwards. In this position the dirt and debris in the dirt container will fall out of the emptying aperture 210. The user can tap the dirt container against the dustbin to dislodge the dirt if necessary.

This means that the dirt bypasses the filter when emptying the dirt container. The use does not have to touch the filter or the soiled parts of the dirt container during a normal emptying action. This means that the user does not get dirt on their hands because the user only touches clean parts of the vacuum cleaner during the emptying action.

In some embodiments the emptying aperture 210 is located on a side other than on the top side of the vacuum cleaner. Similarly the overlap portion 128 is located at a similarly different location to still overlay over the emptying aperture 210. For example the emptying aperture 210 can be located on the underside of the dirt container 110 and the overlap portion 128 is located on the underside of the housing 102.

In other embodiments the filter can be other types of dirt separation means. For example the filter can be a pleated conical filter or a cyclonic separation apparatus. Alternatively the filter can be a bag filter.

In another embodiment two or more embodiments are combined.

Features of one embodiment can be combined with features of other embodiments.

Embodiments of the present invention have been discussed with particular reference to the examples illustrated. However it will be appreciated that variations and modifications may be made to the examples described within the scope of the invention.

The invention claimed is:

1. A vacuum cleaner comprising:

a housing;

a motor fan assembly arranged to generate an air flow, the motor fan assembly located in the housing;

a detachable dirt container mountable to the housing; the dirt container having a dirty air inlet in fluid communication with the motor fan assembly, the dirt container having a first opening;

a filter for separating dirt from the air flow positioned in the first opening, the filter being mounted between the dirt container and the motor fan assembly;

wherein the dirt container comprises an emptying aperture in a wall of the dirt container, the emptying aperture being downstream in the air flow from the dirty air inlet and upstream of the filter; and wherein the housing comprises an integral overlap portion for covering the emptying aperture in the dirt container and sealing the emptying aperture when the detachable dirt container is mounted to the housing and exposing the emptying aperture when the dirt container is removed from the housing.

2. The vacuum cleaner according to claim 1 wherein the dirty air inlet is integral with the dirt container.

3. The vacuum cleaner according to claim 2 wherein the dirty air inlet is an integral nozzle protruding from the dirt container.

4. The vacuum cleaner according to claim 3 wherein the housing comprises a first handle and the dirt container comprises a second handle for holding the dirt container.

5. The vacuum cleaner according to claim 4 wherein the integral nozzle comprises the second handle.

6. The vacuum cleaner according to claim 1 wherein the periphery of the emptying aperture comprises a seal engageable with the overlap portion.

7. The vacuum cleaner according to claim 6 wherein the overlap portion comprises a recess for receiving the seal.

8. The vacuum cleaner according to claim 1 wherein the vacuum cleaner comprises a latch mechanism for selectively releasing the dirt container from the housing.

9. The vacuum cleaner according to claim 8 wherein the latch mechanism comprises a first portion of the latch mechanism on the housing and a second reciprocal portion of the latch mechanism on the dirt container.

10. The vacuum cleaner according to claim 8 wherein the latch mechanism comprises a latch release button mounted in the housing for actuating the latch mechanism.

11. The vacuum cleaner according to claim 10 wherein the housing comprises a first handle and the dirt container comprises a second handle for holding the dirt container;

wherein the latch release button is mounted in the first handle and actuatable with a user's thumb.

12. The vacuum cleaner according to claim 1 wherein the filter is removable from the dirt container.

13. The vacuum cleaner according to claim 1 wherein the emptying aperture is in a top wall of the dirt container and the filter is mounted on a rear wall of the dirt container.

14. The vacuum cleaner according to claim 13 wherein the housing extends in a longitudinal direction and the dirt container is attached and removed from the housing along the longitudinal direction so that the overlap portion slides to cover the emptying aperture.

15. The vacuum cleaner according to claim 1 wherein the vacuum cleaner is a handheld vacuum cleaner.

16. A method for emptying the dirt container of a vacuum cleaner comprising the steps:

providing a vacuum cleaner having housing, a motor fan assembly located in the housing and arranged to generate an air flow, a detachable dirt container mountable to the housing, the dirt container having a dirty air inlet in fluid communication with the motor fan assembly, a filter located in a first opening of the dirt container, wherein the detachable dirt container comprises an emptying aperture in a wall of the dirt container, the emptying aperture being downstream in the air flow from the dirty air inlet and upstream of the filter, wherein the housing comprises an integral overlap portion for covering the emptying aperture in the dirt container and sealing the emptying aperture;

detaching the dirt container from the housing, and the emptying aperture being automatically exposed to the external environment upon detaching of the dirt container; and emptying debris contained in the dirt container through the emptying aperture.

17. The method for emptying the dirt container of a vacuum cleaner according to claim 16, wherein the housing extends in a longitudinal direction and the dirt container is attached and removed from the housing along the longitudinal direction so that the overlap portion slides to cover the emptying aperture.

* * * * *